US009057170B2

(12) United States Patent
Tadros et al.

(10) Patent No.: US 9,057,170 B2
(45) Date of Patent: Jun. 16, 2015

(54) CONTINUOUSLY PRESTRESSED CONCRETE PILE SPLICE

(75) Inventors: Maher K. Tadros, Omaha, NE (US); Hanna E. Kromel, Omaha, NE (US); Quinton G. Patzlaff, Omaha, NE (US); George Morcous, Omaha, NE (US)

(73) Assignee: Nu Tech Ventures, Inc., Lincoln, NE (US)

( * ) Notice: Subject to any disclaimer, the term of this patent is extended or adjusted under 35 U.S.C. 154(b) by 52 days.

(21) Appl. No.: 12/828,439

(22) Filed: Jul. 1, 2010

(65) Prior Publication Data

US 2011/0002744 A1 Jan. 6, 2011

Related U.S. Application Data

(60) Provisional application No. 61/326,008, filed on Apr. 20, 2010, provisional application No. 61/222,138, filed on Jul. 1, 2009.

(51) Int. Cl.
*E02D 5/58* (2006.01)
*E02D 5/30* (2006.01)
(Continued)

(52) U.S. Cl.
CPC ..... *E02D 5/523* (2013.01)

(58) Field of Classification Search
CPC ..... E02D 5/523; E02D 5/526; E04B 1/22; E04B 1/215
USPC ..... 405/231, 232, 233, 239, 251, 252, 405/255–257
See application file for complete search history.

(56) References Cited

U.S. PATENT DOCUMENTS 2,065,507 A * 12/1936 Alexander ..... 405/252
2,724,261 A * 11/1955 Rensaa ..... 52/295
3,163,904 A * 1/1965 Ziolkowski ..... 403/365
(Continued)

FOREIGN PATENT DOCUMENTS

DE 2939472 A * 4/1981
JP 10325140 A * 12/1998

OTHER PUBLICATIONS

Brochure entitled "Kie-Lock, Concrete Pile Supplies" copyright Pile Splices, Inc. May 27, 2010, downloaded from http://www.pilesplices.com, 27 pages.
(Continued)

*Primary Examiner* — John Kreck
*Assistant Examiner* — Stacy Warren
(74) *Attorney, Agent, or Firm* — Davis, Brown, Koehn, Shors & Roberts, P.C.; Sean D. Solberg

(57) ABSTRACT

A pile splice section for a spliced prestressed concrete pile includes a prestressed concrete element including a first end and a second end and a plurality of tendons that extend from the first end to the second end. A first end assembly at the first end of the prestressed concrete element includes a first plate coupled to the plurality of tendons. The first end assembly further includes a plurality of internally threaded fasteners embedded in the first end of the prestressed concrete element that are engagable via apertures extending through the first plate. A second end assembly at the second end of the prestressed concrete element includes a second metal plate coupled to the plurality of tendons. The second end assembly further includes a plurality of apertures extending through the second plate and accessible via pockets proximate the second end of the prestressed concrete element.

11 Claims, 7 Drawing Sheets

(51) Int. Cl.
*E02D 7/00* (2006.01)
*E02D 5/52* (2006.01)

(56) References Cited

U.S. PATENT DOCUMENTS 3,422,630 A * 1/1969 Marier ..... 405/252
3,545,214 A * 12/1970 Grazel ..... 405/252
3,593,532 A * 7/1971 Grazel ..... 405/252
4,050,211 A * 9/1977 Wahman ..... 405/251
4,063,422 A * 12/1977 Marier ..... 405/231
4,314,777 A * 2/1982 Henderson ..... 405/251
4,413,927 A * 11/1983 Silvander ..... 405/252
4,604,003 A * 8/1986 Francoeur et al. ..... 405/256
4,900,193 A * 2/1990 MacKinnon ..... 405/252
4,938,635 A * 7/1990 Russell ..... 405/252
2009/0263189 A9 * 10/2009 Koivunen ..... 403/379.4
2010/0322717 A1 * 12/2010 Paul ..... 405/252

OTHER PUBLICATIONS

Product Brochure entitled "ICP Piles High Performance", Jan. 2006, downloaded from http://www.ijm.com/industry/ICPB/html.

* cited by examiner

CONTINUOUSLY PRESTRESSED CONCRETE PILE SPLICE

CROSS-REFERENCE TO RELATED APPLICATION

This application claims priority to Provisional Application No. 61/222,138, filed Jul. 1, 2009, and to Provisional Application No. 61/326,008, filed Apr. 20, 2010, both of which are herein incorporated by reference in their entireties.

TECHNICAL FIELD

The present invention relates to concrete piles. More particularly, the present invention relates to spliced precast, prestressed concrete piles.

BACKGROUND

Precast, prestressed concrete pilings (PPCP) are commonly used for deep foundations required under bridges, buildings, and marine structures. Every year millions of feet of precast pile are produced in the United States and driven as the anchor of deep foundations on land and in water. Some reasons for using piles as a foundation type include the application of substantial loading on the earth, inadequate structural properties or capacities of the soil, and constraints initiated by the placement of the structure on the site. Advantages for using precast piles include their exceptional structural properties from the use of high strength materials, an unrestrictive pile section size or capacity, along with uniformity and quality due to production in controlled conditions, and resistance to corrosion and durability to the environment.

Generally, PPCPs are designed, manufactured, and supplied to a project in single, long units. This approach limits their applicability to otherwise well-suited projects. Problems that arise from using very long precast piles include, for example, an immense weight and length of the piles, leading to substantial cost and difficulty associated with transportation and its handling, and increased cracking, which requires repairing or replacement of the piles. Another complication with the use of precast piles is the need for each pile length to be accurately calculated in order to minimize waste while achieving the required structural capacity. Problems can result from unexpected geotechnical conditions, found by field investigation, requiring a decrease or increase in a pile's length at the site. Currently, the methods for shortening or extending a precast pre-stressed concrete pile are complex and expensive, in contrast to alternate material counterparts (e.g. timber, steel, reinforced concrete).

SUMMARY

In one aspect, the present invention relates to a pile splice section for a spliced prestressed concrete pile. The pile splice section includes a prestressed concrete element including a first end and a second end. The prestressed concrete element includes a plurality of tendons that extend from the first end to the second end. A first end assembly at the first end of the prestressed concrete element includes a first plate coupled to the plurality of tendons. The first end assembly further includes a plurality of internally threaded fasteners embedded in the first end of the prestressed concrete element that are engagable via apertures extending through the first plate. A second end assembly at the second end of the prestressed concrete element includes a second metal plate coupled to the plurality of tendons. The second end assembly further includes a plurality of apertures extending through the second plate and accessible via pockets proximate the second end of the prestressed concrete element. The apertures are each configured to receive an externally threaded fastener that engages one of the internally threaded fasteners in the first end assembly of an adjacent pile splice section such that actuation of the externally threaded fasteners via the pockets in the prestressed concrete element couples the second end assembly to the first end assembly of the adjacent pile splice section.

In another aspect, the present invention relates to a spliced pile assembly including first and second pile splice sections. Each of the first and second pile splice sections includes a prestressed concrete element, a first end assembly, and a second end assembly. The prestressed concrete element has a first end and a second end and includes a plurality of tendons that extend from the first end to the second end. The first end assembly at the first end of the prestressed concrete element includes a first plate coupled to the plurality of tendons and a plurality of internally threaded fasteners embedded in the first end of the prestressed concrete element. The plurality of internally threaded fasteners are engagable via apertures extending through the first plate. The second end assembly at the second end of the prestressed concrete element includes a second metal plate coupled to the plurality of tendons and a plurality of apertures extending through the second plate and accessible via pockets proximate the second end of the prestressed concrete element. A plurality of externally threaded fasteners extend through the plurality of apertures in the second end assembly of the first pile splice section and engage the internally threaded fasteners in the first end assembly of the second pile splice section The externally threaded fasteners are actuatable via the pockets in the first pile splice section to couple the first pile splice section to the second pile splice section.

In a further aspect, the present invention relates to a method for forming pile splice sections for a spliced prestressed concrete pile. A first pile section form is provided including a first end assembly, a second end assembly, and concrete element form between the first and second end assemblies. The first end assembly includes a first plate at a first end of the concrete element form and the second end assembly comprising a second plate at a second end of the concrete element form. The first end assembly further includes a plurality of internally threaded fasteners coupled to the first plate and extending into the concrete element form. The second end assembly further includes a plurality of bent plates that each defines a pocket extending into the concrete element form. A first plurality of prestress tendons are secured to the first plate and the second plate such that the first plurality of prestress tendons extend through the concrete element form. The first plurality of prestress tendons are then tensioned, and the first end assembly, second end assembly, and concrete element form are filled with concrete such that the internally threaded fasteners are embedded in the concrete and the concrete does not enter the pockets. The tension from the first plurality of prestress tendons is released after allowing the concrete to cure, and the cured concrete is removed from the first pile section form.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1A:
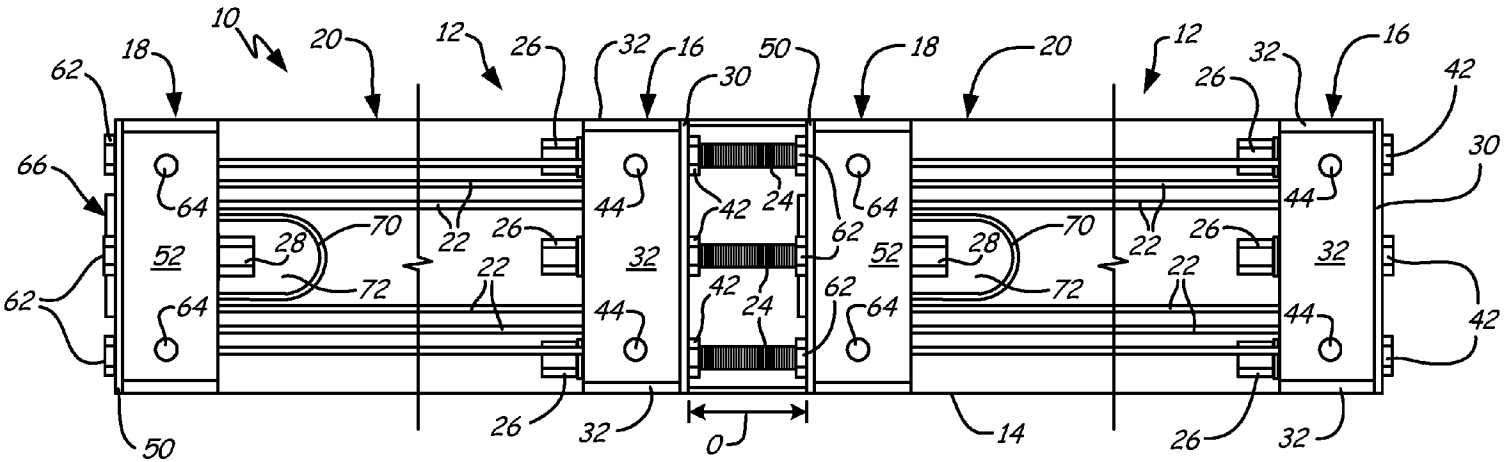
FIG. 1A is a first side view and FIG. 1B is a cross-sectional view of an embodiment of a pile splice section fabrication system for fabricating pile splice sections for a spliced prestressed concrete piling.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Figure 1B:
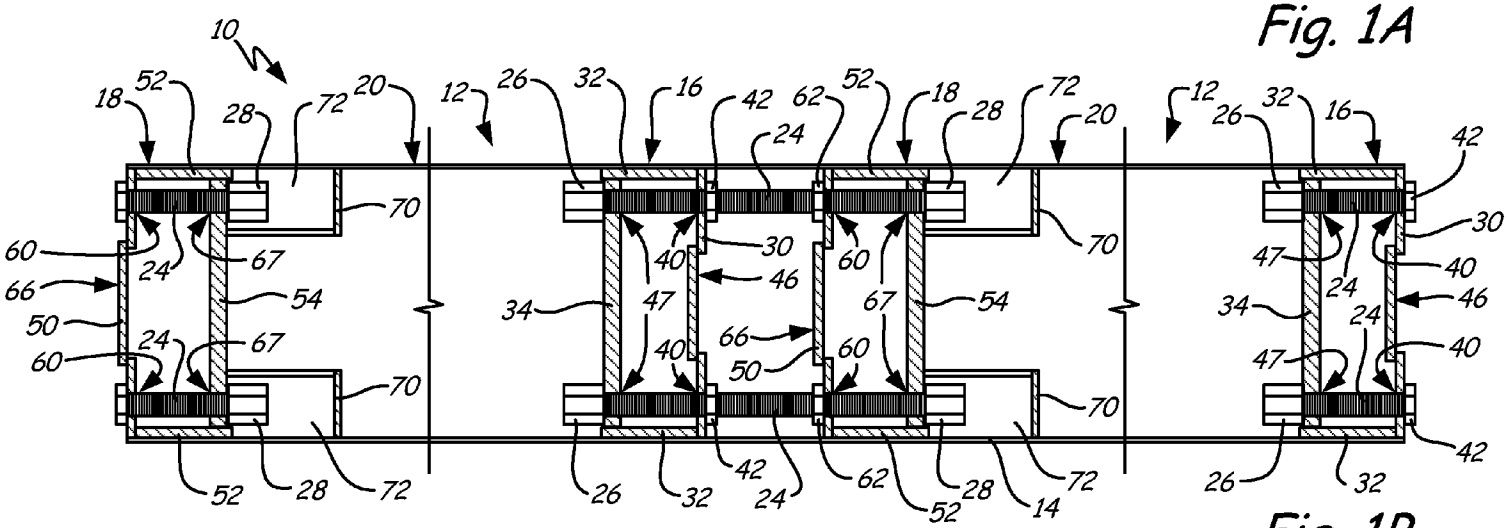

FIG. 1A is a first side view and FIG. 1B is a cross-sectional view of an embodiment of a pile splice section fabrication system 10 for fabricating pile splice sections for a spliced prestressed concrete piling. The cross-sectional view shown in FIG. 1B depicts a plane parallel to the top of the system 10 approximately midway through the system 10. The system 10 includes pile section forms 12 disposed in a prestress bed 14. While two pile section forms 12 are illustrated in FIGS. 1A and 1B, the system 10 may alternatively be configured to fabricate other numbers of pile section forms.

The pile section forms 12 each include a first end assembly 16, a second end assembly 18, and a concrete element form 20. The concrete element form 20 of each pile section form 12 is disposed between the first end assembly 16 and the second end assembly 18. A plurality of prestress tendons 22 extend between the first end assembly 16 and the second end assembly 18 through the concrete element form 20. In the embodiment shown, the pile section forms 12 are coupled to each other with a plurality of externally threaded fasteners 24. The externally threaded fasteners 24 couple to internally threaded fasteners 26 adjacent the first end assembly 16 on one end and to internally threaded fasteners 28 at the other end. In one embodiment, four externally threaded fasteners 24 couple to four internally threaded fasteners 26, 28 at each end. In an exemplary implementation, the externally threaded fasteners 24 are all-thread bars. The process of assembling the system 10 will be described in more detail below. While not shown, the externally threaded fasteners 24 at the ends of the system 10 may be coupled to additional pile splice section forms 12, or may be configured to couple to the bed 14.

The first end assembly 16 comprises a plurality of plates arranged to form an enclosure. Particularly, the first end assembly 16 comprises a cap plate 30, a plurality of side plates 32, and an end plate 34. The side plates 32 extend perpendicularly from the cap plate 30 and the end plate 34. The cap plate 30 is disposed on an end of the side plates 32 opposite the end plate 34. In some embodiments, the cap plate 30, side plates 32, and end plate 34 are comprised of a metal, such as steel or iron. In an alternative embodiment, the second end assembly 18 is formed without side plates 52.

The cap plate 30 includes a plurality of apertures 40 configured to receive the externally threaded fasteners 24 for securing the pile splice forms 12 to each other and/or to the bed 14 during fabrication of the pile splice sections. In some embodiments, the cap plate 30 is secured to the first end assembly 16 with a plurality of jam nuts 42 threaded over the externally threaded fasteners 24 on a side of the cap plate 30 opposite the side plates 32.

In some embodiments, the cap plate 30 also defines a coupling feature or key form 46. The coupling feature form 46 provides a coupling feature in the concrete after the pile splice section 12 is fabricated. The coupling feature is configured to engage or mate with a coupling feature on an adjacent pile splice section when the pile splice sections are assembled into a spliced pile. The process of assembling the pile splice sections will be described in more detail below with regard to FIGS. 4A and 4B. In the embodiment shown, the coupling feature form 46 defines a structure that forms an indentation or female feature in the concrete disposed in the first end assembly 16 that is configured to mate with a corresponding protrusion or male feature (formed in the second end assembly 18 by a coupling feature form, as described in more detail below). While a substantially square shaped coupling feature form 46 is shown, the coupling feature form 46 may have any shape or configuration. For example, a universal coupling feature form may be defined in both end assemblies 16 and 18 such that the pile splice sections can be coupled to each other from either end. The pile splice section forms 12 may also be fabricated such that some of the pile splice sections have one coupling feature at both ends (e.g., a female feature) and some of the pile splice sections have a different, mating coupling feature at both ends (e.g., male feature).

The side plates 32 are secured to the end plate 34, such as by welding. Alternatively, the side plates 32 and end plate 34 may be formed as a uniform piece with cast metal, such as cast iron or cast steel. In some embodiments, the side plate 32 at the top of the system 10 includes one or more fill holes 44. As will be described in more detail herein, the fill holes 44 provide apertures through which the first end assembly 16 is filled with concrete. While the cap plate 30, side plates 32, and end plate 34 are shown as forming a box-like structure for the first end assembly 16, the cap plate 30, side plates 32, and end plate 34 may be configured for pile splice sections having a different shape. For example, if the pile splice forms 12 are cylindrical, the cap plate 30 and end plate 34 may be round and the side plate(s) 32 may be rounded to form a cylindrical first end assembly 16.

The end plate 34 defines a first end of the concrete element form 20. The end plate 34 includes a plurality of apertures 47 that extend through the end plate 34 to allow the externally threaded fasteners 24 to couple with the internally threaded fasteners 26. In some embodiments, the internally threaded fasteners 26 are mechanically secured (e.g., welded) to the end plate on a side facing the concrete element form 20. The internally threaded fasteners 26 may be, for example, hex nuts. A washer may be secured between the internally threaded fasteners 26 and the end plate 34.

Figure 2A:
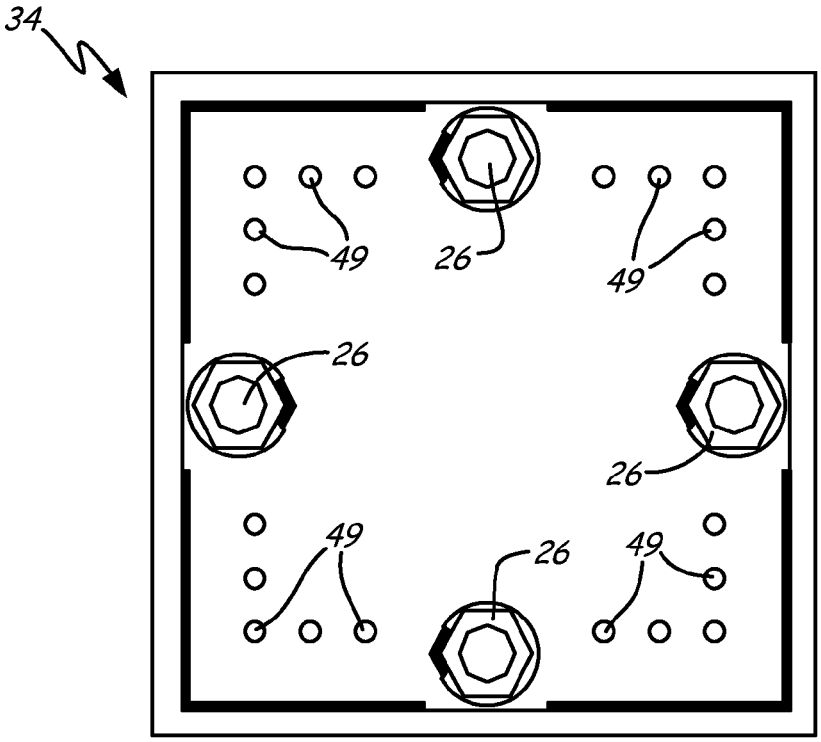
FIG. 2A is a first side view and FIG. 2B is a second side view of a first end plate from a first end assembly in the pile splice section fabrication system.
Figure 2B:
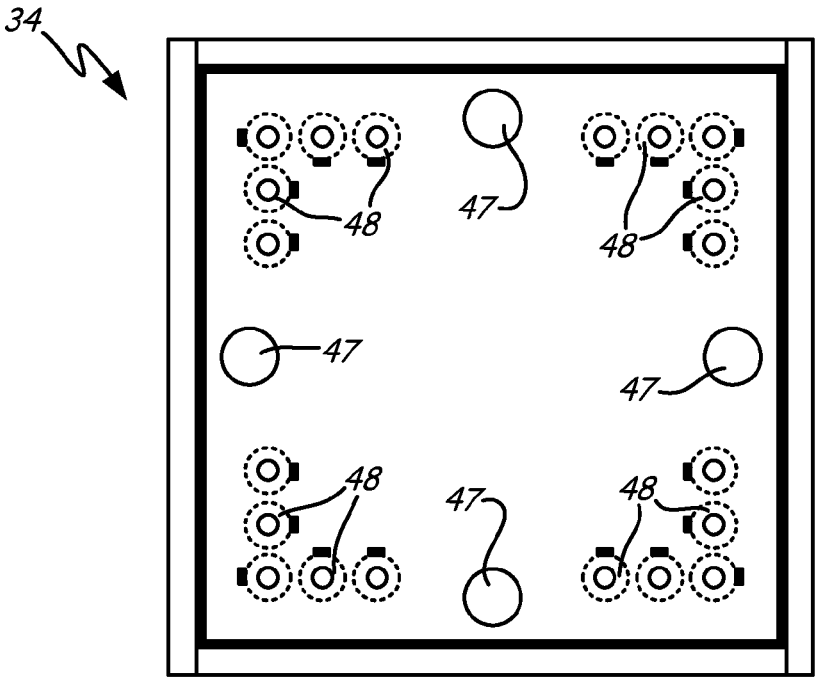

FIG. 2A is a first side view and FIG. 2B is a second side view of an embodiment of the end plate 34. In the embodiment shown, the end plate 34 includes four internally threaded fasteners 26 secured to the end plate 34 such that the internally threaded fasteners 26 are engagable by the externally threaded fasteners 24 via the apertures 47. In some embodiments, the internally threaded fasteners 26 and apertures 47 are approximately centered along the side edges of the end plate 34. In an alternative embodiment, the internally threaded fasteners 26 and apertures 47 are disposed proximate the corners of the end plate 34.

Also shown in FIGS. 2A and 2B are a plurality of chucks 48 that secure the prestress tendons 22 with respect to the first end assembly 16. In some embodiments, the chucks 48 are mechanically secured to the end plate 34. In other embodiments, the chucks 48 are housed or embedded within the end plate 34, or the chucks 48 are housed in a cast metal housing. The end plate 34 includes a plurality of tendon apertures 49, which provide interfaces through which the prestress tendons 22 can be inserted into the chucks 48 from the concrete element form 20. The prestress tendons 22 extend into the first end assembly 16 a predetermined amount, and the chucks 48 hold the prestress tendons 22 when the prestress tendons 22 are tensioned during the fabrication process. In some embodiments, the chucks 48 are one-time use chucks. While twenty chucks 48 are shown coupled to the end plate 34, any suitable number of chucks 48 to accommodate a corresponding number of prestress tendons 22 may be coupled to the end plate 34, depending on the desired design characteristics of the pile splice section.

Referring back to FIGS. 1A and 1B, the second end assembly 18 also comprises a plurality of plates arranged to form an enclosure. Particularly, the second end assembly 18 comprises a cap plate 50, a plurality of side plates 52, and an end plate 54. The side plates 52 extend perpendicularly from the cap plate 50 and the end plate 54. The cap plate 50 is disposed on an end of the side plates 52 opposite the end plate 54. In some embodiments, the cap plate 50, side plates 52, and end plate 54 are comprised of a metal, such as steel or iron. In an alternative embodiment, the second end assembly 18 is formed without side plates 52.

The cap plate 50 includes a plurality of apertures 60 configured to receive the externally threaded fasteners 24 for securing the pile splice forms 12 to each other and/or to the bed 14 during fabrication of the pile splice sections. In some embodiments, the cap plate 50 is secured to the second end assembly 18 with a plurality of jam nuts 62 threaded over the externally threaded fasteners 24 on a side of the cap plate 50 opposite the side plates 52.

In some embodiments, the cap plate 50 also defines a coupling feature or key form 66. The coupling feature form 66 generates a coupling feature in the concrete after the pile splice section 12 is fabricated. The coupling feature created by the coupling feature form 66 is configured to engage or mate with a coupling feature on an adjacent pile splice section when the pile splice sections are assembled into a spliced pile. In the embodiment shown, the coupling feature form 66 defines a structure that forms a protrusion or male feature in the concrete that is configured to mate with a corresponding indentation or female feature (formed in the first end assembly 16, as described above). Similar to the coupling feature form 46 discussed above, while a substantially square shaped coupling feature form 66 is shown, the coupling feature form 66 may have any shape or configuration.

The side plates 52 are secured to the end plate 54, such as by welding. Alternatively, the side plates 32 and end plate 34 may be formed as a uniform piece with cast metal, such as cast iron or cast steel. In some embodiments, the side plate 52 at the top of the system 10 includes one or more fill holes 64. As will be described in more detail herein, the fill holes 64 provide apertures through which the second end assembly 18 is filled with concrete. While the cap plate 50, side plates 52, and end plate 54 are shown as forming a box-like structure for the second end assembly 18, the cap plate 50, side plates 52, and end plate 54 may be configured for pile splice sections having a different shape (e.g., cylindrical).

The end plate 54 defines a second end of the concrete element form 20. The end plate 54 includes a plurality of apertures 67 that extend through the end plate 54 to allow the externally threaded fasteners 24 to couple with the internally threaded fasteners 28. In some embodiments, the internally threaded fasteners 28 are secured to the externally threaded fasteners 24 after the pile splice section forms 12 are positioned in the bed 14. The internally threaded fasteners 28 may be, for example, hex nuts. A washer may be positioned between the internally threaded fasteners 28 and the end plate 54.

The end plate 54 further includes a plurality of bent plates 70 that define pockets 72 around the apertures 67 in the end plate 54. The bent plates 70 are mechanically secured to the end plate 54, such as be welding. Alternatively, the bent plates 70 may be formed continuous with the end plate 54 using metal casting. As will be described in more detail herein, the bent plates 70 form a barrier from the concrete pour such that, after the concrete cures, a pocket or opening on the side of the concrete element is formed to provide access to fasteners extending through the apertures 67.

In an alternative embodiment, both end plates 34 and 54 include a bent plate such that pockets are defined around the apertures in both end plates 34 and 54. This alternative embodiment allows a single type of end plate to be stocked for fabrication, and allows either end of the completed pile splice section to be coupled to spliced pile assembly to add to its length.

Figure 3A:
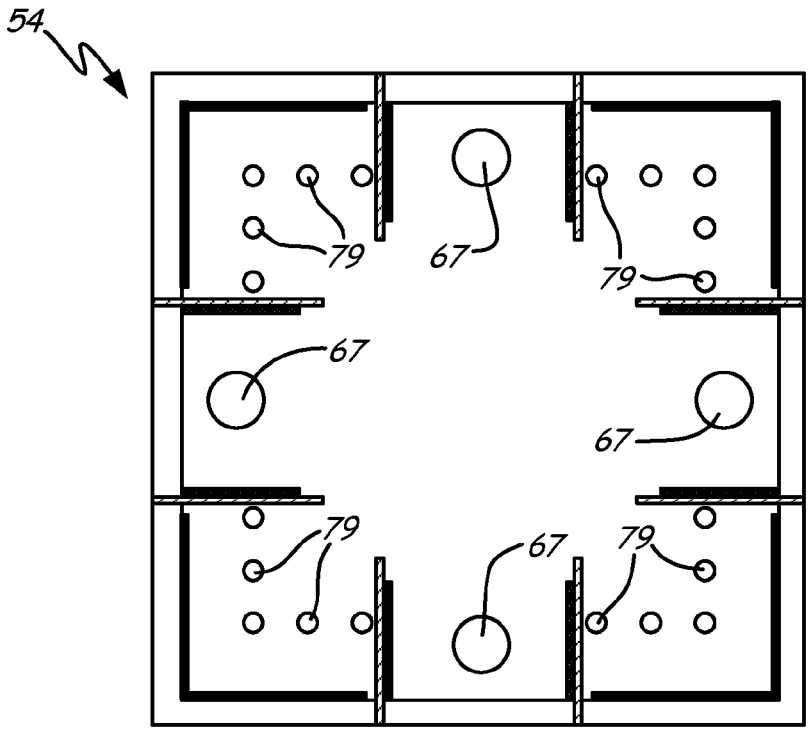
FIG. 3A is a first side view and FIG. 3B is a second side view of a second end plate from a second end assembly in the pile splice section fabrication system.
Figure 3B:
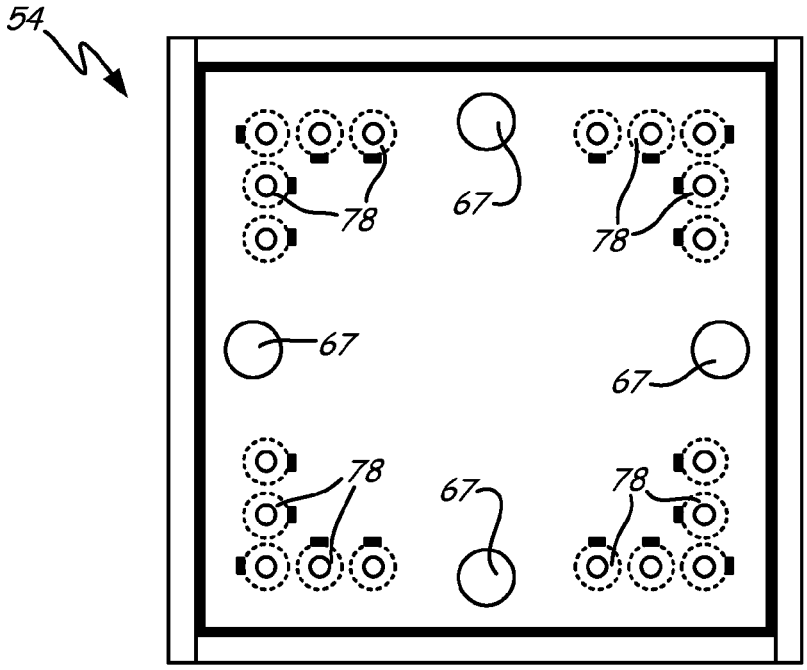

FIG. 3A is a first side view and FIG. 3B is a second side view of an embodiment of the end plate 54. In the embodiment shown, the end plate 54 includes four apertures 67 approximately centered along the side edges of the end plate 54. In an alternative embodiment, the apertures 67 are disposed in proximate the corners of the end plate 54.

Also shown in FIGS. 3A and 3B are a plurality of chucks 78 that secure the prestress tendons 22 with respect to the second end assembly 18. In some embodiments, the chucks 78 are mechanically secured to the end plate 54. In other embodiments, the chucks 78 are housed or embedded within the end plate 34, or the chucks 78 are housed in a cast metal housing. The end plate 54 includes a plurality of tendon apertures 79, which provide interfaces through which the prestress tendons 22 can be inserted into the chucks 78 from the concrete element form 20. The prestress tendons 22 extend into the second end assembly 18 a predetermined amount, and the chucks 78 hold the prestress tendons 22 when the prestress tendons 22 are tensioned during the fabrication process. In some embodiments, the chucks 78 are one-time use chucks. While twenty chucks 78 are shown coupled to the end plate 54, any suitable number of chucks 78 to accommodate a corresponding number of prestress tendons 22 may be coupled to the end plate 54, depending on the desired design characteristics of the pile splice section.

Referring again to FIGS. 1A and 1B, the system 10 may be prepared for pouring the concrete in a variety of ways. In one example, the prestress tendons 22 are cut to lengths that are calculated to provided proper elongation at the desired stress. The prestress tendons 22 are positioned such that equal lengths remain exposed at the end of the bed 14 for tensioning.

The end plates 34 and side plates 32 of the first end assemblies 16 are then placed in the bed 14, and the prestress tendons 22 are inserted and set in the chucks 48. The prestress tendons 22 are set such that substantially equal lengths of the prestress tendons 22 extend into the first end assemblies 16. In one exemplary implementation, the prestress tendons 22 extend approximately three inches from the chucks 48.

The externally threaded fasteners 24 are then inserted into the internally threaded fasteners 26 on the first end assemblies 16. In some embodiments, the externally threaded fasteners 24 are covered or coated in a material (e.g., a polymer) that prevents the concrete from adhering to them during the curing process. The cap plate 30 is then placed on the externally threaded fasteners 24.

The cap plate 50, side plates 52, and end plate 54 of the second end assemblies 18 of the adjacent pile splice section form 12 are then respectively positioned onto the externally threaded fasteners 24. The prestress tendons 22 extend from the first end assembly 16 across the concrete element form 20 to the second end assembly 18 and are inserted and set in the chucks 78 of the end plate 54. The prestress tendons 22 are set such that substantially equal lengths of the prestress tendons 22 extend into the second end assembly 18. In one exemplary implementation, the prestress tendons 22 extend approximately three inches from the chucks 78.

The jam nuts 42 and 62 are then actuated to secure the cap plates 30 and 50 to the first end assembly 16 and second end assembly 18, respectively. The length of the externally threaded fasteners 24 is selected such that a distance d is maintained between the splice section forms 12 through the curing process, as shown in FIG. 1A. Material may then be placed in or around the bent plates 70 to prevent concrete from entering the pockets 72. When assembled, the prestress tendons 22 are tensioned (e.g., using hydraulic jacks) to a predetermined stress. Reinforcement may be placed in the bed 14 to assure that the stress on the prestress tendons 22 does not affect the positioning or spacing of the components of the pile splice section forms 12. The prestress tendons 22 may be tensioned by gang tensioning all strands simultaneously to prevent uneven tensioning of individual strands. Alternatively, the prestress tendons 22 may be simultaneously tensioned from both ends of the bed.

Concrete is then poured into the first end assembly 16 (via the holes 44), the second end assembly 18 (via the holes 64), and the concrete element form 20. In some embodiments, the concrete has a strength in a range of about 7-10 kips per square inch (ksi) (48.3-69.0 MPa).

In an alternative embodiment, continuous prestress tendons are extended the entire length of the bed such that the prestress tendons extend through both of the splice section forms 12. An embodiment in which continuous prestress tendons extend the length of the bed is described below with regard to FIG. 5.

Returning to FIGS. 1A and 1B, after the concrete has cured for a predetermined time, the tension is released from the prestress tendons 22 to transfer the tension to the surrounding cured concrete. The portions of the prestress tendons 22 extending beyond the forms 12 are then cut from both ends of the bed 14 to allow for removal of the pile sections from the system 10. The pile splice sections may be removed simultaneously from the bed 14, and the pile sections separated by loosening the internally threaded fasteners 28 (accessed via the pockets 72 formed in the concrete). Alternatively, the jam nuts 42 and 62 can be loosened to separate the cap plates 30 and 50 from the connected pile splice sections, and the externally threaded fasteners 24 can be turned to disengage the externally threaded fasteners 24 from the embedded internally threaded fasteners 26 to remove the pile sections from the bed separately.

Figure 4A:
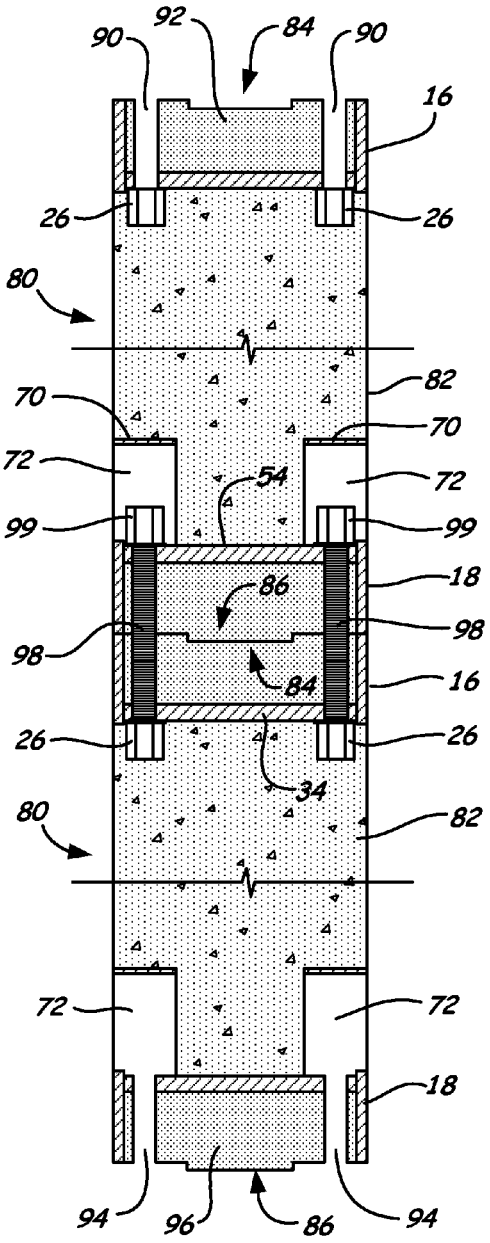
FIG. 4A is a first cross-sectional view and FIG. 4B is a second cross-sectional view of an embodiment of pile splice sections spliced together.
Figure 4B:
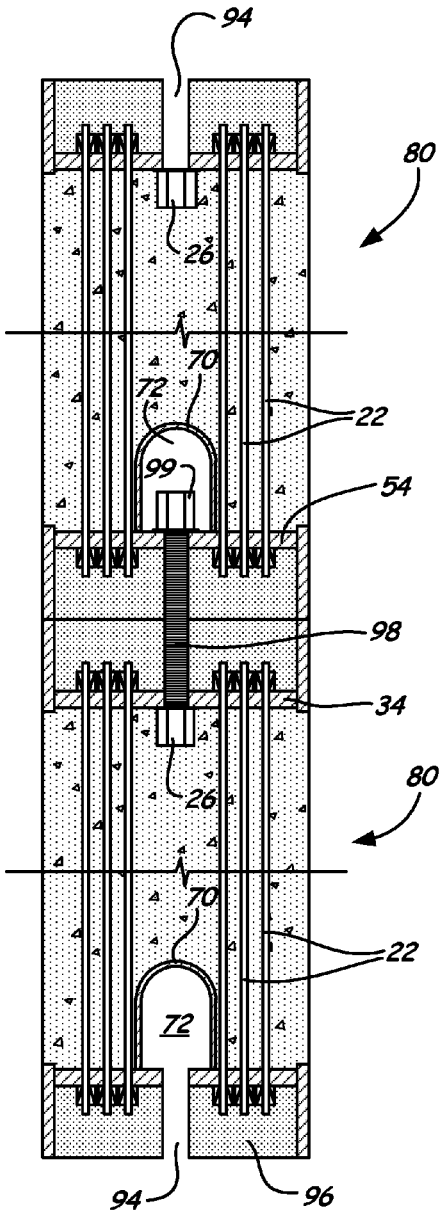

FIGS. 4A and 4B illustrate cross-sectional views of an embodiment of two spliced pile splice sections 80 formed in the system 10 of FIGS. 1A and 1B. The cross-sectional view shown in FIG. 4A depicts an imaginary plane extending through the center of the pile splice sections 80 and the cross-sectional view shown in FIG. 4B depicts an imaginary plane parallel with the imaginary plane of FIG. 4A and extending through the chucks 48, 78 in line with the apertures 46, 66 (FIGS. 2B, 3B).

The pile splice sections each include the first end assembly 16, second end assembly 18, and prestressed concrete element 82 extending between the first end assembly 16 and second end assembly 18. In some embodiments, in the completed pile splice section 80, the first end assembly 16 does not include the cap plate 30 and the second end assembly does not include the cap plate 50. Each of these open-ended enclosures is filled with cured concrete and includes a coupling element that provides an interface with an adjacent pile splice section. In the embodiment shown, the first end assembly 16 includes an indentation or female coupling element 84 and the second end assembly 18 includes a protrusion or male coupling element 86.

Variations on the mechanisms employed to couple the pile splice sections 80 are also possible. For example, as discussed above, the end assemblies 16, 18 may be configured to include substantially identical coupling elements to allow either end of the pile splice section 80 to be coupled to an adjacent pile splice section 80 in the pile assembly. The coupling elements may be cast in the concrete of the end assemblies 16, 18, or may be provided on a plate attached to the end assemblies 16, 18. One variation on this concept is to include hemispherical indentations in each of the end assemblies 16, 18, and a ball of material (e.g., metal, such as iron) is placed on a partially driven splice pile assembly to help locate the next pile on the assembly.

When the externally threaded fasteners 24 are removed from the first end assembly 16 and second end assembly 18 in the system 10 (FIGS. 1A and 1B), apertures are formed that extend through the cured concrete in the end assemblies 16, 18. Particularly, the first end assembly 16 includes a plurality of apertures 90 that extend through the concrete 92 of the first end assembly 16 to the embedded internally threaded fasteners 26, and the second end assembly includes a plurality of apertures 94 that extend through the concrete 96 of the second end assembly 16 to the pockets 72 formed in the concrete element 82.

When the pile splice sections 80 are at a project site, the splice sections 80 are assembled into a spliced pile having a total length to satisfy results from geotechnical investigations and design calculations. A first pile splice section 80 is driven into the earth. In some embodiments, a driving plate (not shown) configured to support the female coupling feature 84 is placed over the first end assembly 16 during driving. A base plate may also be placed over the male coupling feature 86 on the bottom of the pile section 80 to provide additional support.

When the first pile section 80 is at the desired depth, the driving plate is removed from the top of the first end assembly 16. An externally threaded fastener 98 is inserted through each of the apertures 90 in the first end assembly 16 and into the embedded internally threaded fasteners 26. Next, a second pile splice section 80 is lowered onto the first pile splice section 80 such that the male coupling feature 86 on the second end assembly 18 of second pile splice section 80 is inserted into the female coupling feature 84 on the first end assembly 16 of an adjacent pile splice section 80. When the coupling features 84, 86 are mated, the apertures 90 on the first end assembly 16 align with the apertures 94 of the second end assembly 18. The externally threaded fasteners 98 extend through the coupled apertures 90, 94 and into the pockets 72 via the coupled apertures 90 and 94. The externally threaded fasteners 98 are then secured by torquing hex nuts 99 coupled to the externally threaded fasteners 98. This couples the two adjacent pile splice sections 80 to each other. In some embodiments, the externally threaded fasteners 98 are tensioned to a torque of at least about 1,000 ft-lbs. To prevent the hex nuts 99 from loosening or unwinding during pile driving, the hex nuts 99 may be welded to the second end plate 54, or jam nuts may be secured between the hex nuts 99 and the second end plate 54.

The spliced pile sections 80 are then driven as described above to a desired depth, and then an additional spliced pile section 80 is added and secured to the splice pile. This process continues until a spliced pile having the desired length is assembled.

When coupled together, the pretensioning of one splice section 80 is transferred across the splice joint to the adjacent splice section 80. Particularly, the prestressing from the prestress tendons 22 of one pile splice section 80 is transferred over the cap plate 34 and through the externally threaded fasteners 98 across the splice to the cap plate 54 of the adjacent pile splice section 80 and back into the prestress tendons 22 of the adjacent pile splice section 80. Consequently, the assembled spliced pile assembly has substantially similar strength characteristics as a continuous pile. In addition, the transferring of pretensioning across the splice joint prevents the splice joint from rebounding or separating during driving, and improves stability of the assembly if there are any side loads during or after driving the assembly into the ground.

Figure 5:
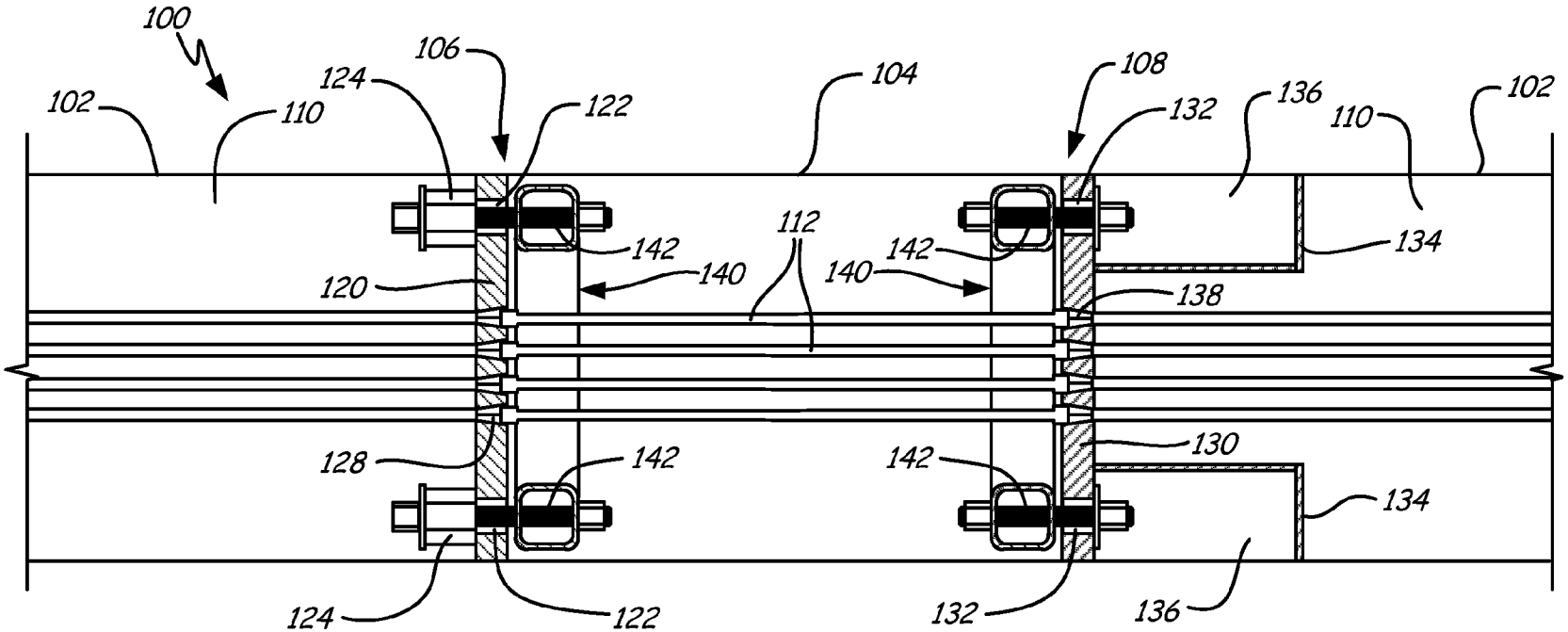
FIG. 5 is a cross-sectional view of another embodiment of a pile splice section fabrication system including continuous tendons between the pile splice section forms.

FIG. 5 is a cross-sectional view of a portion of a system 100 for fabricating splice pile sections according to another embodiment. The cross-sectional view shown in FIG. 5 depicts a plane parallel to the top of the system 100 approximately midway through the system 100. The system 100 includes pile section forms 102 disposed in a prestress bed 104. FIG. 5 illustrates the coupling between the two forms 102 in the prestress bed 104. While two pile section forms 102 are illustrated in FIG. 5, the system 100 may alternatively be configured to fabricate other numbers of pile section forms.

The pile section forms 102 each include a first end assembly 106, a second end assembly 108, and a concrete element form 110. The concrete element form 110 of each pile section form 102 is disposed between the first end assembly 106 and the second end assembly 108. In this embodiment, a plurality of continuous prestress tendons 112 extend the length of the prestress bed 104 through both of the pile section forms 102. The pile section forms 102 are coupled to each other via the continuous prestress tendons 112.

The first end assembly 106 includes an end plate 120 including a plurality of apertures 122 that each provide access to an internally threaded fastener 124 coupled to the end plate 120 on the side of the end plate 120 facing the concrete element form 110. In some embodiments, the internally threaded fasteners 124 are welded to the end plate 120. The end plate 120 also includes a plurality of chucks 128 coupled to or embedded in the end plate 120. In some embodiments, the chucks 128 are one-time use chucks. The first end assembly 106 can alternatively be configured substantially similarly to the first end assembly 16 above to define an enclosure.

The second end assembly 108 includes an end plate 130 including a plurality of apertures 132. The end plate 130 further includes a plurality of bent plates 134 that define pockets 136 around the apertures 132 in the end plate 130. The bent plates 134 are mechanically secured to the end plate 130, such as be welding. Alternatively, the bent plates 134 are formed continuous with the end plate 130 with metal casting. The bent plates 134 form a barrier from the concrete pour such that, after the concrete cures, an opening on the side of the concrete element is formed to provide access to fasteners extending through the apertures 132. The end plate 130 also includes a plurality of chucks 138 coupled to or embedded in the end plate 130. In some embodiments, the chuck 138 are one-time use chucks. The second end assembly 108 can alternatively be configured substantially similarly to the second end assembly 18 above to define an enclosure.

To prepare the system 100 for fabrication of the pile splice sections, the end assemblies 106, 108 are positioned in the bed 104. Seating boxes 140 are also positioned adjacent each of the end plates 120, 130 in the area between the pile section forms 102 in the bed 104. The seating boxes 140 are coupled to the end plates 120, 130 using externally threaded fasteners 142.

The prestress tendons 112 are then threaded through the chucks 128, 138 of the end assemblies 106, 108 and the seating boxes 140, and wedges (not shown) are inserted into the tapered holes of the chucks 128, 138. The prestress tendons 112 are then tensioned (e.g., using a hydraulic jack), and reinforcement may be placed in the bed 104 to assure that the stress on the prestress tendons 112 does not affect the positioning or spacing of the components of the pile splice section forms 102.

The end plates 120, 130 may then be adjusted as necessary to square the end plates 120, 130 with respect to the pile forms 102. The externally threaded fasteners 142 are then torqued to partially seat the wedges in the tapered holes of the chucks 128, 138 by urging the seating boxes 140 against the wedges. A sealant material may then be applied around the prestress tendons 112 to block off the tapered holes of the chucks 128, 138. Material may also be placed in or around the bent plates 134 to prevent concrete from entering the pockets 136.

Concrete is then poured into the concrete element form 110. In some embodiments, the concrete has a strength in a range of about 7-10 kips per square inch (ksi) (48.3-69.0 MPa). After the concrete has cured for a predetermined time, the tension is released from the prestress tendons 112 to transfer the tension to the surrounding cured concrete. The portions of the prestress tendons 112 extending beyond the forms 102 are then cut from both ends of the bed 104 and between the pile splice section forms 102 to allow for removal of the pile sections from the system 100. The pile splice sections then may be removed individually from the bed 104, and the seating box 140, externally threaded fasteners 142, and any non-embedded internally threaded fasteners are removed for reuse on subsequent pile splice section fabrication processes. The exposed prestress tendons 112 are then ground to be flush with the end plates 120, 130.

Figure 6:
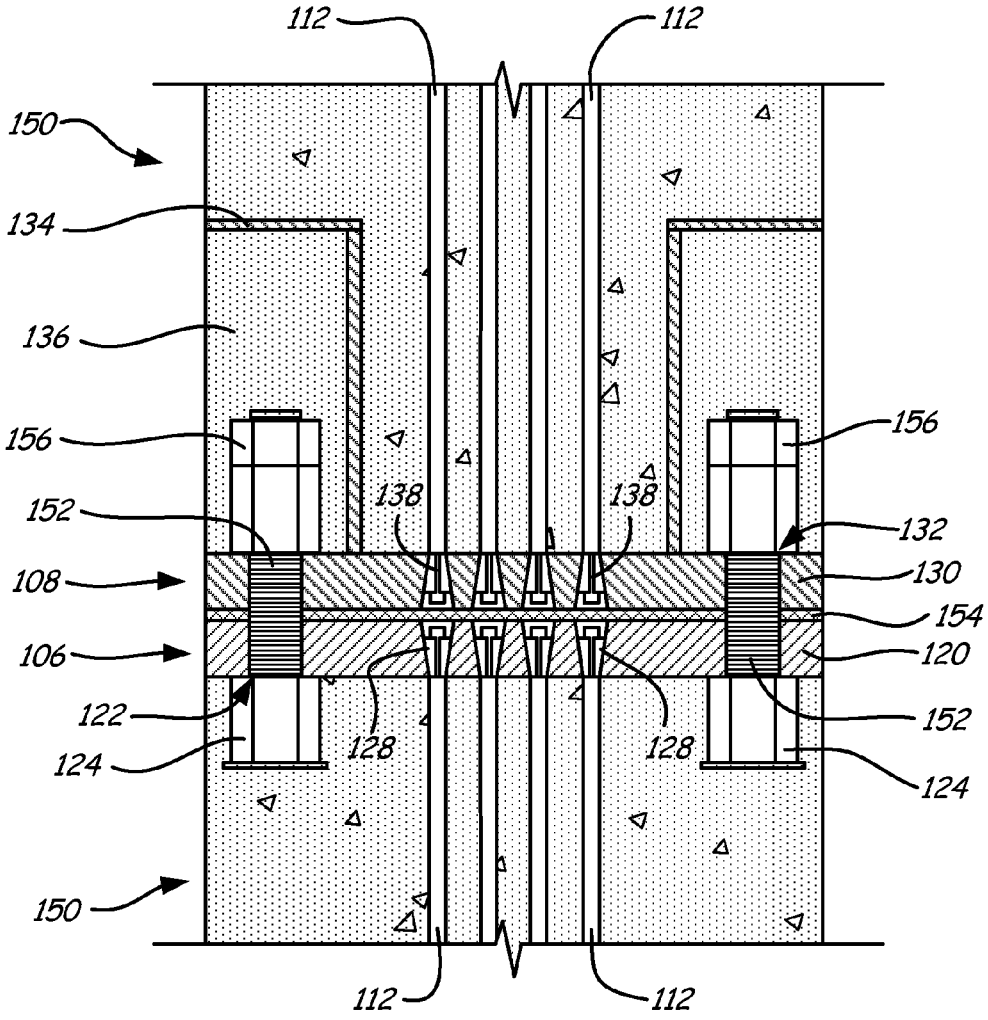
FIG. 6 is a cross-sectional view of pile splice sections formed in the system of FIG. 5 spliced together.

FIG. 6 is a cross-sectional view of an embodiment of two spliced pile splice sections 150 formed in the system 100 of FIG. 5. When the pile splice sections 150 are at a project site, the splice sections 150 are assembled into a spliced pile having a total length to satisfy results from geotechnical investigations and design calculations. A first pile splice section 150 is driven into the earth. In some embodiments, a driving plate (not shown) is placed over the first end assembly 106 during driving. A base plate may also be placed over the bottom of the pile section 150 to provide additional support.

When the first pile section 150 is at the desired depth, the driving plate is removed from the top of the first end assembly 106. An externally threaded fastener 152 is inserted through each of the apertures 122 in the first end assembly 106 and into the embedded internally threaded fasteners 124. In some embodiments, a cushioning material 154 is positioned on the end plate 120.

Next, a second pile splice section 150 is lowered onto the first pile splice section 150 (and cushioning material 154) such that the apertures 122 on the first end assembly 106 align with the apertures 132 of the second end assembly 108. The externally threaded fasteners 152 extend through the coupled apertures 122, 132 and into the pockets 136 via the coupled apertures 122, 132. The externally threaded fasteners 152 are then secured by torquing hex nuts 156 coupled to the externally threaded fasteners 152. This couples the two adjacent pile splice sections 150 to each other. In some embodiments, the externally threaded fasteners 152 are tensioned to a torque of at least about 1,000 ft-lbs.

The spliced pile sections 150 are then driven as described above to a desired depth, and then an additional spliced pile section 150 is added and secured to the splice pile. This process continues until a spliced pile have the desired length is assembled.

Figure 7:
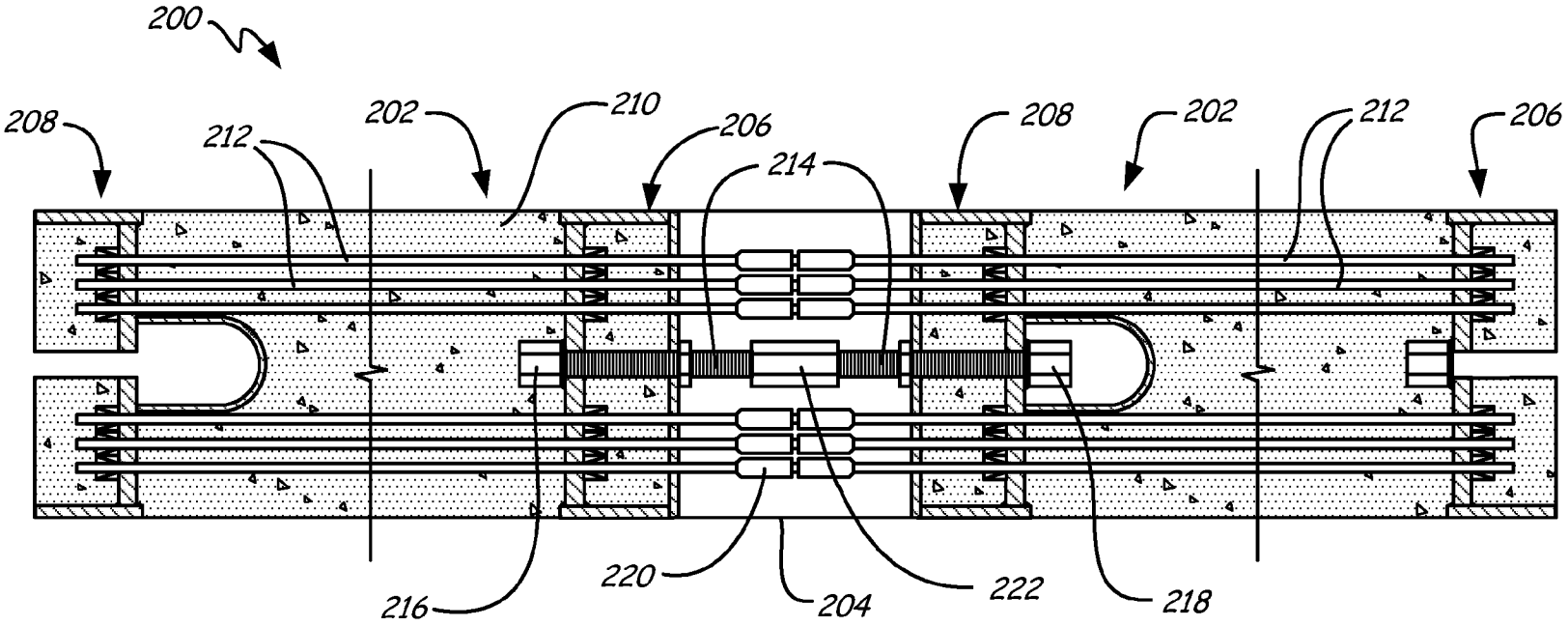
FIG. 7 is a cross-sectional view of another embodiment of a pile splice section fabrication system including tendons that are coupled between the pile splice section forms.

FIG. 7 is a cross-sectional view of another embodiment of a pile splice section fabrication system 200 for fabricating pile splice sections for a spliced prestressed concrete piling. The cross-sectional view shown in FIG. 7 depicts a plane parallel to the top of the system 200. The system 200 includes pile section forms 202 disposed in a prestress bed 204. While two pile section forms 202 are illustrated in FIG. 7, the system 200 may alternatively be configured to fabricate other numbers of pile section forms.

The pile section forms 202 each include a first end assembly 206, a second end assembly 208, and a concrete element form 210. The concrete element form 210 of each pile section form 202 is disposed between the first end assembly 206 and the second end assembly 208. A plurality of prestress tendons 212 extend between the first end assembly 206 and the second end assembly 208 through the concrete element form 210. In the embodiment shown, the pile section forms 202 are coupled to each other with a plurality of externally threaded fasteners 214. The externally threaded fasteners 214 couple to internally threaded fasteners 216 adjacent the first end assembly 206 on one end and to internally threaded fasteners 218 at the other end. In one embodiment, four externally threaded fasteners 214 couple to four internally threaded fasteners 216, 218 at each end. In an exemplary implementation, the externally threaded fasteners 214 are all-thread bars.

The embodiment shown in FIG. 7 includes similar components and configurations to the embodiment shown in FIGS. 1A and 1B. However, in this embodiment, the prestress tendons 212 extend into the space between the forms 202 and are coupled to each other with turnbuckles 220. The externally threaded fasteners 214 are also coupled to each other between the forms 202 with a coupling nut 222. The turnbuckles 220 allow for adjustment of the tension in each of the prestress tendons 212 individually, thereby allowing for discrete control of the tension in each of the prestress tendons 212 in the event that gang tensioning of the prestress tendons 212 is not an option. In addition, the turnbuckles 220 provide an additional interface for releasing the tension in the prestress tendons 212 and facilitate removal of the forms 202 from the bed 204 after the concrete has cured. It is noted that the turnbuckles 220 may also be employed in the embodiment of FIGS. 1A and 1B including discontinuous prestress tendons, or in the embodiment of FIG. 5 including continuous prestress tendons.

Splicing of precast prestressed pile splice sections as described allows the use of multiple shorter, lighter pile sections to be connected in a way to achieve the overall strength of one equivalent long piles. The shorter spliced sections provide several advantages over long continuous piles. For example, the shorter pile splice sections weigh less, use smaller equipment for transport and handling, reduce internal stresses and cracking from its own weight while handling, eliminates precise pile length design and manufacture, and allows for reducing or extending a pile's length based on field observations. Furthermore, standardization can be achieved for optimal precast pile design and manufacture.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The following is claimed:

1. A spliced pile assembly comprising:

first and second pile splice sections each including:

a prestressed concrete element including a first end and a second end, the prestressed concrete element including a plurality of tendons that extend from the first end to the second end;

a first end assembly at the first end of the prestressed concrete element including a first plate having a plurality of chucks on a side opposite the prestressed concrete element, wherein each chuck is coupled to one of the plurality of tendons before the concrete is poured, the first plate further comprising a first wall extending perpendicularly from the first plate away from the prestressed concrete element, wherein the first plate and first wall define an open-ended first enclosure that is filled with concrete, the first end assembly further including a plurality of internally threaded fasteners embedded in the first end of the prestressed concrete element, the plurality of internally threaded fasteners engagable via apertures extending through the first plate; and a second end assembly at the second end of the prestressed concrete element including a second metal plate having a plurality of chucks on a side opposite the prestressed concrete element, wherein each chuck is coupled to one of the plurality of tendons before the concrete is poured, the second plate further comprising a second wall extending perpendicularly from the second plate away from the prestressed concrete element, wherein the second plate and second wall define an open-ended second enclosure that is filled with concrete the second end assembly further including a plurality of apertures extending through the second plate and accessible via pockets proximate the second end of the prestressed concrete element; and a plurality of externally threaded fasteners extending through the plurality of apertures in the second end assembly of the first pile splice section and engaging the internally threaded fasteners in the first end assembly of the second pile splice section, wherein the externally threaded fasteners are actuatable via the pockets in the first pile splice section to couple the first pile splice section to the second pile splice section.

2. The spliced pile assembly of claim 1, wherein the concrete of the first end assembly of each of the first and second pile splice sections defines a first coupling structure at the open end of the open-ended first enclosure, and the concrete of the second end assembly of each of the first and second pile splice sections defines a second coupling structure at the open end of the open-ended second enclosure, and wherein the second coupling structure of the first pile splice section mates with the first coupling structure of the second pile splice section.

3. The spliced pile assembly of claim 1, wherein the externally threaded fasteners are tensioned to a torque of at least about 1,000 ft-lbs.

4. The spliced pile assembly of claim 1, wherein the externally threaded fasteners comprise all-thread bars, and wherein the internally threaded fasteners comprise nuts.

5. The spliced pile assembly of claim 4, wherein the nuts are jam nuts.

6. The spliced pile assembly of claim 1, wherein the concrete has a strength in a range of about 7-10 kips per square inch (ksi).

7. The spliced pile assembly of claim 1, further comprising cushioning material positioned between the second end assembly of the first pile splice section and the first end assembly of the second pile splice section.

8. The spliced pile assembly of claim 1, wherein the plurality of prestress tendons of the first pile splice section are discontinuous with the plurality of prestress tendons of the second pile splice section.

9. The spliced pile assembly of claim 1, wherein the plurality of prestress tendons of the first pile splice section are continuous with the plurality of prestress tendons of the second pile splice section.

10. The spliced pile assembly of claim 1, wherein the plurality of externally threaded fasteners of the first and second pile splice sections comprise four externally threaded fasteners.

11. The spliced pile assembly of claim 10, wherein the plurality of internally threaded fasteners of the first and second pile splice sections comprise four internally threaded fasteners.

* * * * *